US009993917B1

(12) United States Patent
Vosbikian et al.

(10) Patent No.: US 9,993,917 B1
(45) Date of Patent: Jun. 12, 2018

(54) HANDGRIP FOR CLEANING TOOL HANDLES

(71) Applicants: Peter S Vosbikian, Moorestown, NJ (US); Robert Petner, Burlington, NJ (US)

(72) Inventors: Peter S Vosbikian, Moorestown, NJ (US); Robert Petner, Burlington, NJ (US)

(73) Assignee: Zenith Innovation, LLC, Moorsetown, NJ (US)

( * ) Notice: Subject to any disclaimer, the term of this patent is extended or adjusted under 35 U.S.C. 154(b) by 0 days. days.

(21) Appl. No.: 15/672,956

(22) Filed: Aug. 9, 2017

(51) Int. Cl.
*B25G 1/10* (2006.01)
*A46B 5/02* (2006.01)
*B25G 3/26* (2006.01)

(52) U.S. Cl.
CPC ..... *B25G 1/102* (2013.01); *A46B 5/02* (2013.01); *B25G 3/26* (2013.01)

(58) Field of Classification Search
CPC .. B25G 1/102; B25G 1/10; B25G 3/26; A46B 5/02; A46B 5/021
USPC ..... 16/421, 430; D4/129, 138; D8/107
See application file for complete search history.

(56) References Cited

U.S. PATENT DOCUMENTS 1,858,529 A * 5/1932 Spicklemire ..... B25G 1/102 223/102
2,389,882 A * 11/1945 Wood, Jr. ..... F41B 13/08 30/151

FOREIGN PATENT DOCUMENTS

EP 2383051 A1 * 11/2011 ..... B21D 1/06

* cited by examiner

*Primary Examiner* — Laura C Guidotti
(74) *Attorney, Agent, or Firm* — Stuart M. Goldstein

(57) ABSTRACT

A handgrip for the handle of a cleaning tool, and particularly a push broom, has a frustum shaped front section with side walls tapering downwardly from an outwardly extending upper lip portion to an opening at the terminus of the front section. The opening is shaped to retain the cleaning tool handle. A stock shaped rear section extends downwardly from the front section. The rear section has a curved top wall which merges smoothly downward into curved sidewalls and merges upwards to the lip portion. A curved notch is formed between the lip portion and the top wall. This configuration allows the user to maintain a comfortable grasp of the handgrip, eliminating the strain and risk of injury, while ensuring that the user's hand does not slip off the handle.

3 Claims, 8 Drawing Sheets

HANDGRIP FOR CLEANING TOOL HANDLES

FIELD OF THE INVENTION

The present invention relates to cleaning tools and specifically to an ergonomically designed handgrip for elongated handles which facilitates highly effective cleaning functions without causing discomfort and strain to the user.

BACKGROUND OF THE INVENTION

Handles for cleaning tools, and for push brooms in particular, are routinely straight and continuous or, in some cases, curved slightly rearward and downward. As a result, the user operating the push broom is required to grasp the handle with one hand over the other, bent over, to apply a downward, pushing force with his or her arms. This is an unnatural motion which causes undue strain on the user's back, forearms, hands and wrists. The upper hand, especially, is more severely strained, since it is the hand which imparts the pushing force into the forward motion of the broom, while the wrist is bent at an uncomfortable and inefficient angle. Of course these physical problems result from the requirement that the user exert excessive force in order to effectively clean a surface. Current handles are also not configured to prevent the user's hand from slipping off the handle.

Although there have been various handgrips proposed for push broom and similar cleaning tool handles, none have been developed which have successfully provided an effective and efficient cleaning tool, while still allowing the user to maintain a comfortable, non-injurious position during the cleaning process.

SUMMARY OF THE INVENTION

It is thus the object of the present invention to provide a handgrip for a cleaning tool, particularly a push broom or like cleaning tools, which overcomes the disadvantages and limitations of prior handle handgrips.

It is an object of the present invention to provide a handgrip for a cleaning tool handle which allows the user to maintain a comfortable and safe cleaning position, while using a push broom or like cleaning tool.

It is another object of the present invention to provide a handgrip for a cleaning tool handle which allows the user to stand substantially upright while using a push broom or like cleaning tool during the cleaning process.

It is still another object of the present invention to provide a handgrip for a cleaning tool handle which significantly eliminates the strain and risk of injury to the user's back, forearms, wrist, and hands while using a push broom or like cleaning tool during the cleaning process.

It is a further object of the present invention to provide a handgrip for a cleaning tool handle which is ergonomic in design, such that it comfortably and naturally fits into the user's hand.

It is another object of the present invention to provide a handgrip for a cleaning tool handle which has a curved notch, providing a built-in physical stop for the user's hand, which aids in the application of pushing force and prevents the hand from slipping off the handgrip.

It is still another object of the present invention to provide a handgrip for a cleaning tool handle which is economical to manufacture and readily and easily installed onto the end of push broom and comparable cleaning tool handles.

These and other objects are accomplished by the present invention, a hand grip for the handle of a cleaning tool, and particularly a push broom, which comprises a frustum shaped front section with side walls tapering downwardly from an outwardly extending upper lip portion to an opening at the terminus of the front section. The opening is shaped to accept and retain the handle of a cleaning tool. A stock shaped rear section extends downwardly from the front section. The rear section has a curved top wall which merges smoothly downward into curved side walls and merges upwards to the lip portion. A curved notch is formed between the lip portion and the top wall. The curved side walls of the rear section merge smoothly downward into a lower wall of the rear section. This configuration allows the user to maintain a comfortable grasp of the handgrip, eliminating the strain and risk of injury to the user's back, forearms, wrists, and hands. Significantly, the curved notch feature prevents the user's hand, positioned within the notch, from slipping off the handgrip while the cleaning tool is being used.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
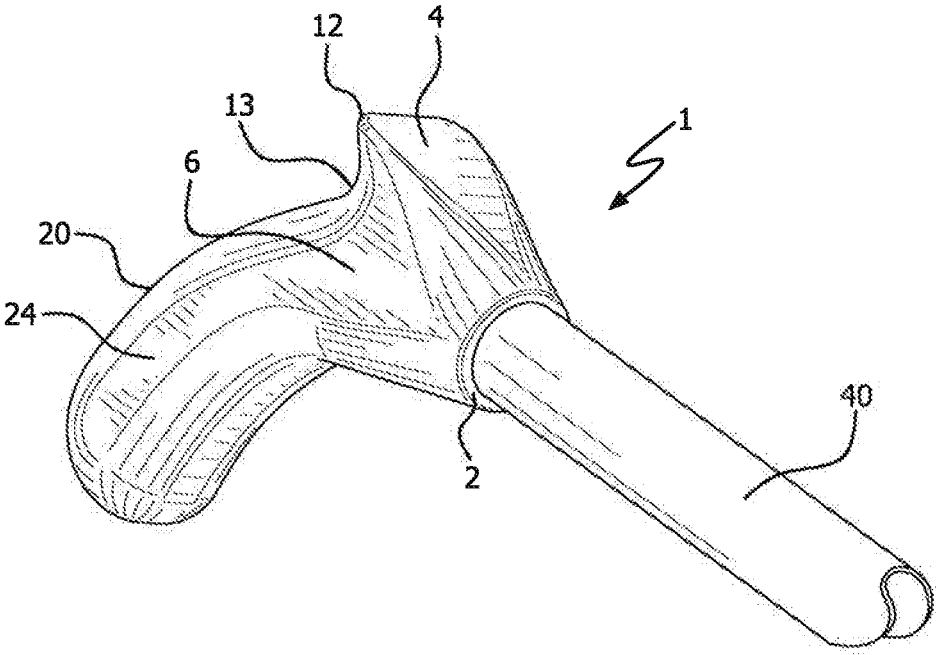
FIG. 1 is a front perspective view of the handgrip of the present invention.
Figure 1A:
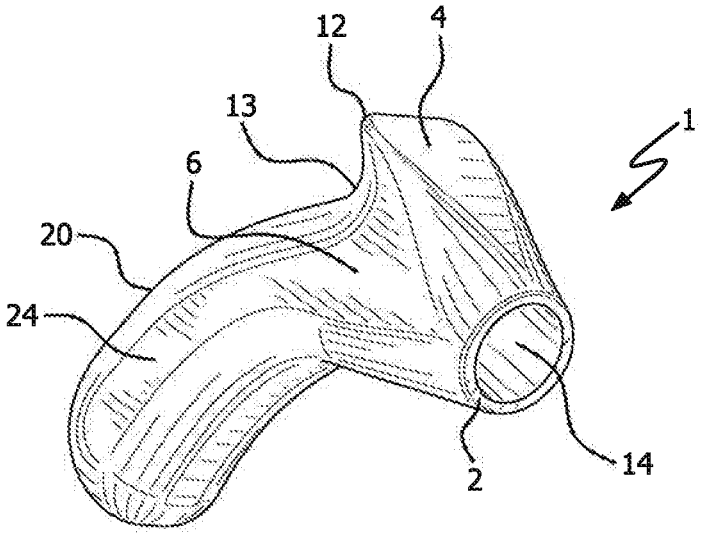
FIG. 1A is a front perspective view of the handgrip of the present invention without the attached cleaning tool handle.
Figure 2:
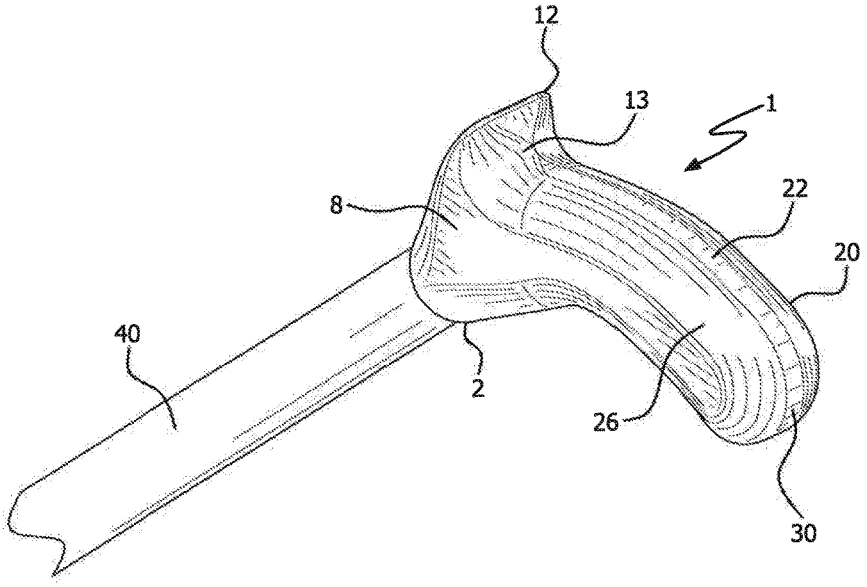
FIG. 2 is a rear perspective view of the handgrip of the present invention.
Figure 3:
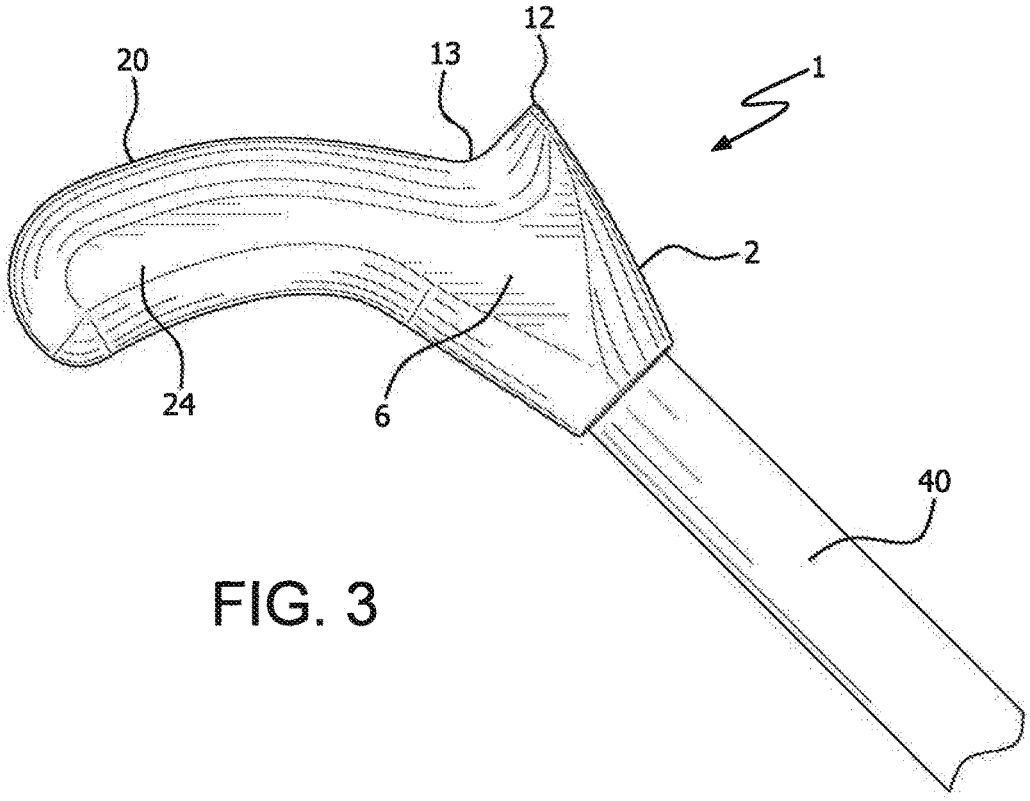
FIG. 3 is an elevation view of the handgrip of the present invention.
Figure 4:
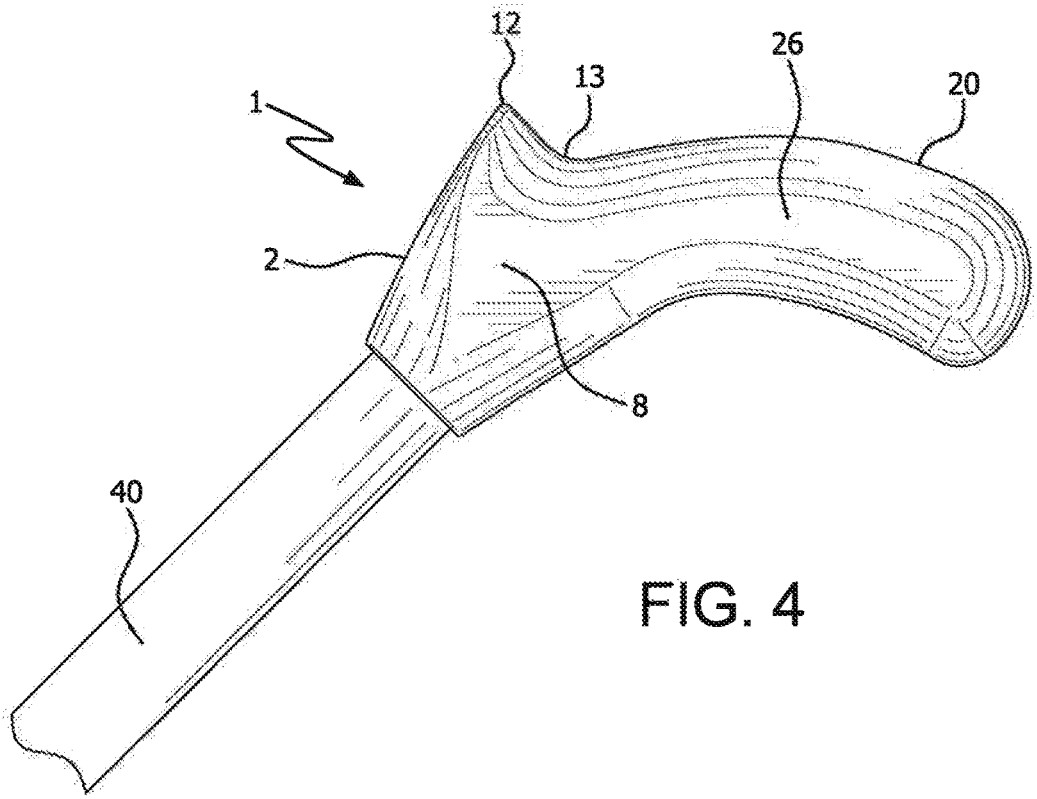
FIG. 4 is the opposite elevation view of the handgrip of the present invention.
Figure 5:
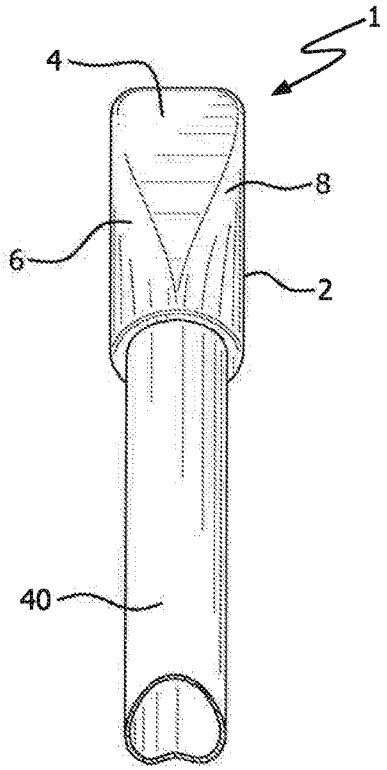
FIG. 5 is a front view of the handgrip of the present invention.
Figure 6:
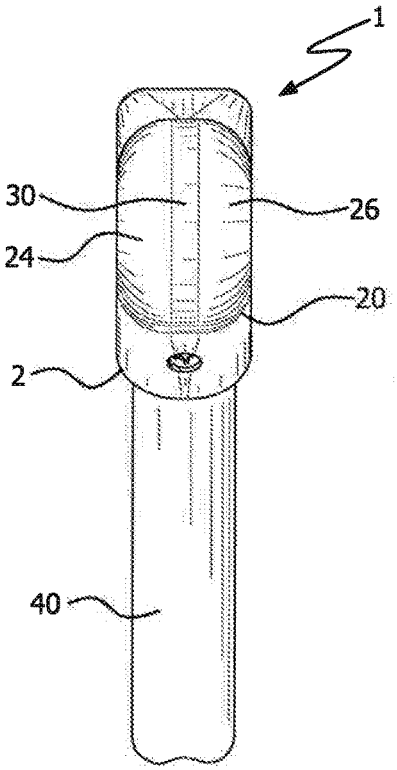
FIG. 6 is a rear view of the handgrip of the present invention.
Figure 7:
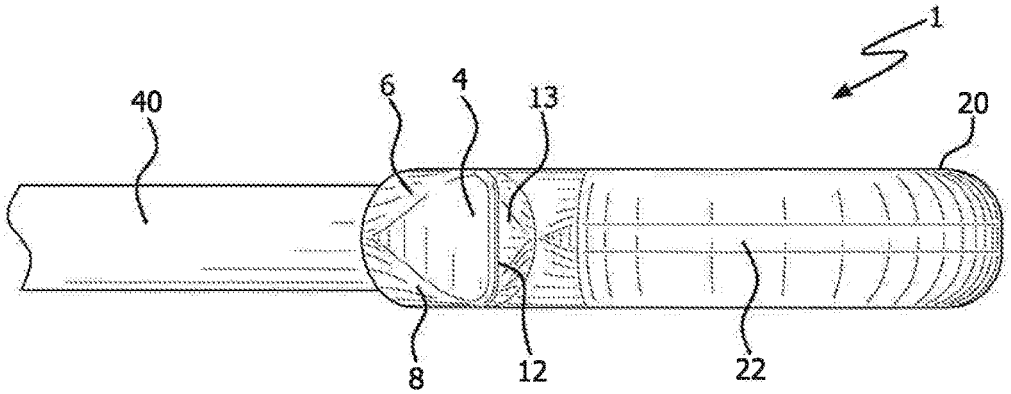
FIG. 7 is a top view of the handgrip of the present invention.
Figure 8:
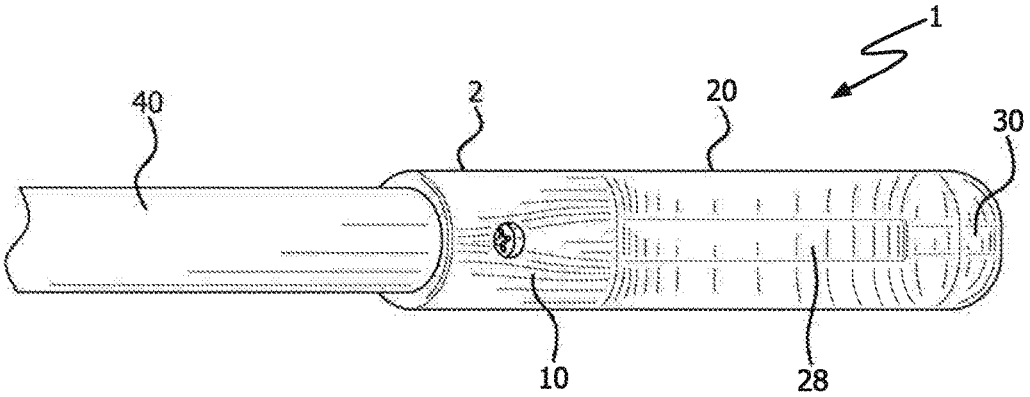
FIG. 8 is a bottom view of the handgrip of the present invention.

Handgrip 1 of the invention comprises frustum shaped front section 2 having exterior walls comprising top wall 4, shallow concave side walls 6 and 8, and substantially straight bottom wall 10. Top wall 4 and side walls 6 and 8 taper downward from outwardly extending upper lip portion 12, to opening 14 at the terminus of front section 2. Opening 14 is shaped and configured to accept and retain handle 40 of cleaning tool 50. Side walls 6 an 8 also extend downward to merge smoothly into bottom wall 10.

Figure 11:
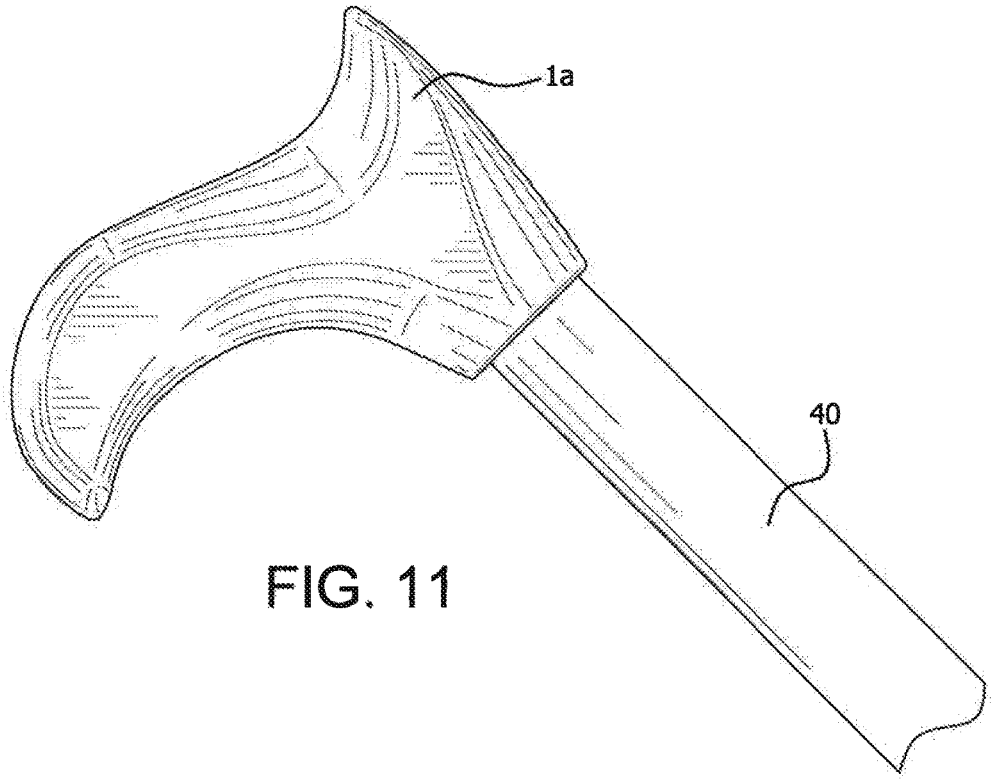
FIG. 11 is an elevation view of an alternate embodiment of the handgrip of the present invention.
Figure 12:
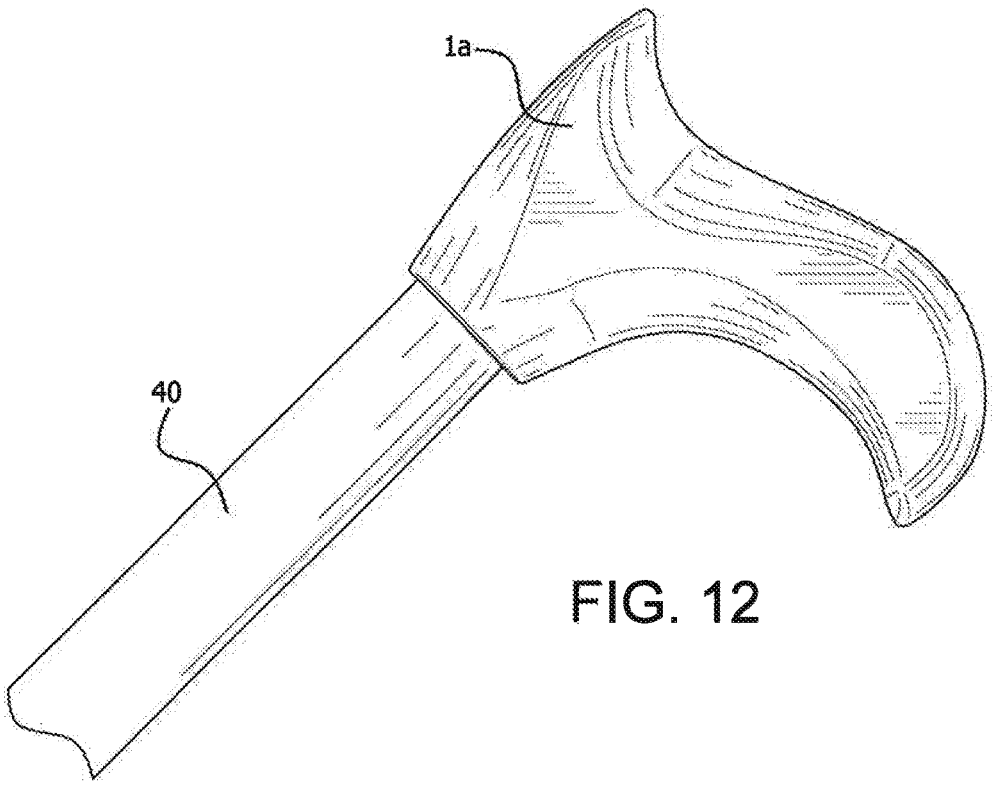
FIG. 12 is the opposite elevation view of the alternate embodiment of the handgrip of the present invention.

Handgrip 1 also comprises stock shape rear section 20 which extends downwardly from front section 2. The FIGS. show that rear section 20 extends down from front section 2 at an angle of approximately 45°. However, it is contemplated that this angle can be between 45° and 90°. Elevation views of handgrip 1*a* having an alternate angle are shown in FIGS. 11 and 12.

Rear section 20 has curved exterior top wall 22 which merges smoothly downward into curved side walls 24 and 26. Top wall 22 also merges smoothly upwards to lip portion 12, forming notch 13 between the lip portion and the top wall. Curved side walls 24 and 26 merge smoothly downward into lower wall 28 of rear section 20. Rear section 20 also has closed bottom end wall 30.

Handgrip 1 of the present invention is thus ergonomically designed to provide the user with a more efficient and less strenuous means of utilizing a cleaning tool, such as push broom 50. The design of handgrip 1 permits the handgrip to be grasped comfortably, while allowing the user to exert more downwardly, forward force on push broom 50 during the cleaning operation; but still allowing the user to assume an upright stance.

Handgrip 1 is designed such that the user's thumb is positioned within notch 13 of rear section 20, with the palm of the user spread over curved top wall 2, and the remaining fingers wrapped around lower wall 28. This configuration serves to prevent undo stress on or jamming of the fingers while push broom 50 is being used. Handgrip 1 further has a built-in stop, formed by lip portion 12 and notch 13, which also aids in the application of the pushing force, and, significantly, prevents the user's hand from slipping off the handgrip during use.

Figure 9:
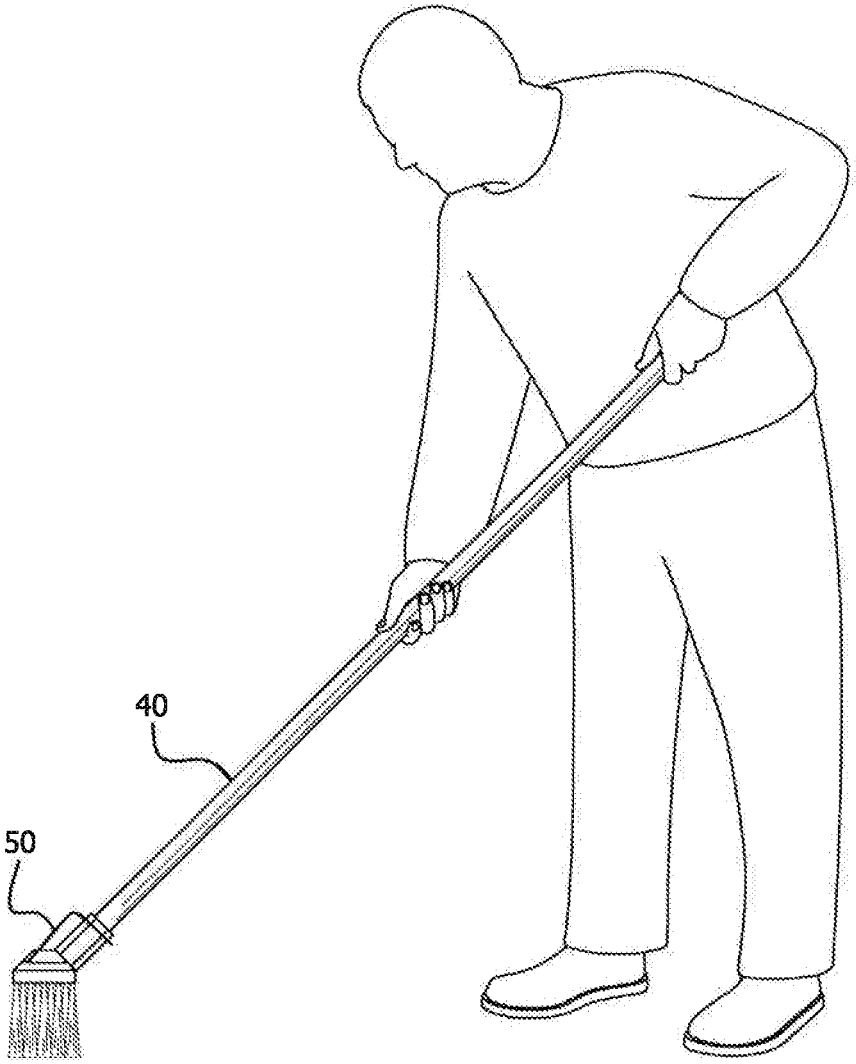
FIG. 9 (Prior Art)
FIG. 9 is a representation of the manner a typical push broom is used.
Figure 10:
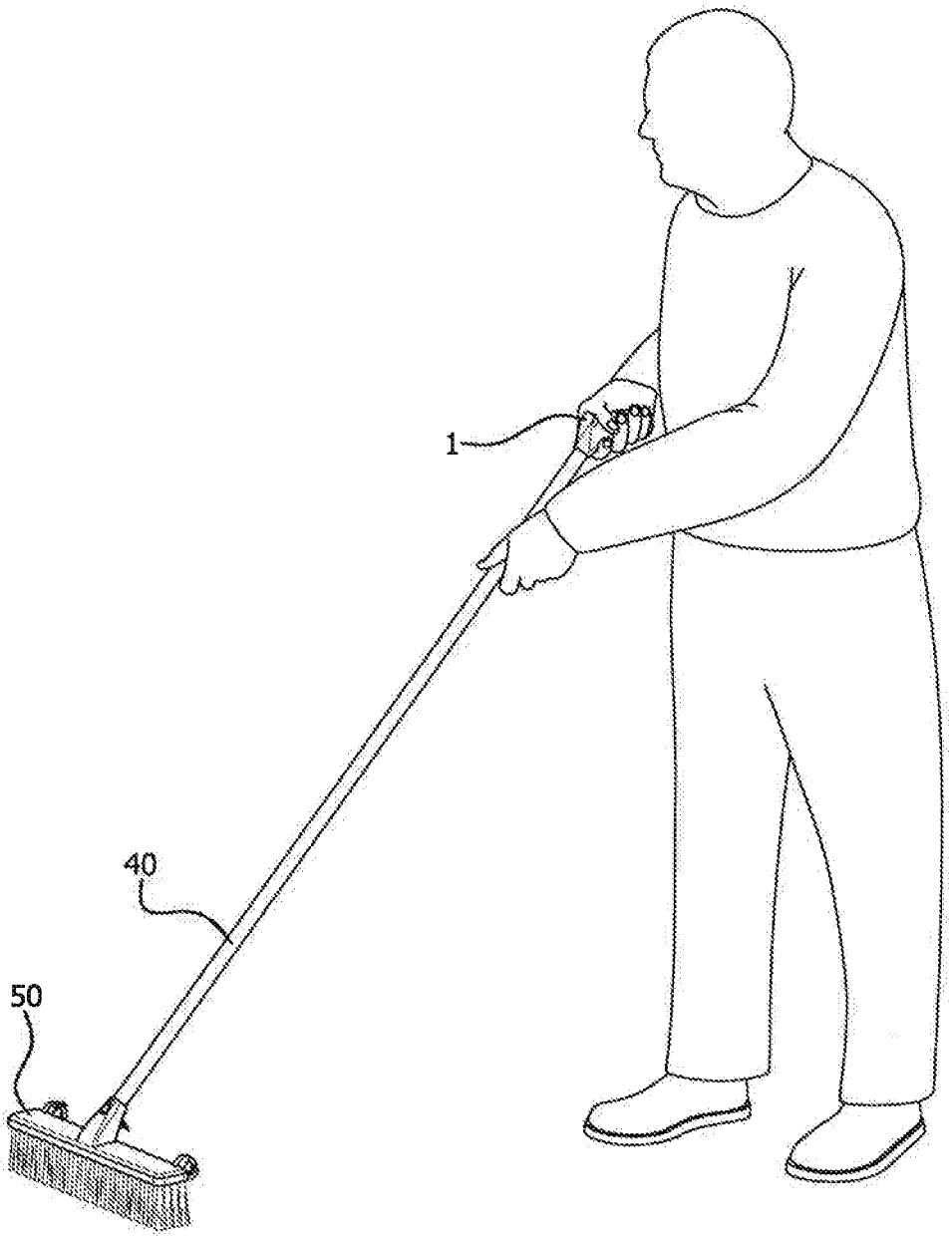
FIG. 10 is a representation of the manner a push broom having the handgrip of the present invention is used.

Use of handgrip 1 on a typical cleaning tool like push broom 50 allows the user to stand upright during the cleaning operation, which vastly reduces the strain on the back. See FIG. 10. The positioning of the hand on handgrip 1 decreases the stress on the hand and wrist, since the user's hand grasps the handgrip comfortably with his or her thumb positioned in notch 13. This is in distinct contrast to the usual manner a push broom is utilized, which compels the user to wrap the fingers of both hands around the handle, thereby requiring the user to bend over to apply the pushing force necessary to use the broom. See FIG. 9. In fact, handgrip 1 allows the user to accomplish the actual pushing and surface cleaning with the top hand, while using the second hand merely to guide the broom. The second hand need not provide any pushing force.

While the handgrip of the present invention is primarily described for use with a push broom, it is contemplated that the handgrip is configured to be used on any cleaning tool with an elongated handle, such as a squeegee, deck scrubber, or scrapper. The handgrip is also designed to be used in an inverted position when attached to the handle of a cleaning tool having a cleaning element on both the top and on the bottom of its cleaning head, e.g. a mop which utilizes a sponge element on one side and a squeegee element on the flip side. Handgrip 1*a*, shown in FIGS. 11 and 12, would be conducive for this purpose.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A handgrip for the handle of a cleaning tool, said handgrip comprising:

an integral body comprising:

a front section having exterior walls which all taper uniformally downwardly from an outwardly extending upper lip portion to an opening at the terminus of the front section, said opening being shaped to accept and retain the handle of a cleaning tool, the exterior walls comprising front section top and shallow concave side walls which extend downward to merge smoothly into a substantially straight bottom wall; and a stock shaped rear section having a length greater than the front section, said rear section extending downwardly from the front section and having a curved, convexly round shaped top wall which merges smoothly downward into convexly round shaped curved side walls as an uninterrupted continuation of the convexly round shaped top wall, said top wall merging smoothly upwards to the lip portion, forming a curved, concave shape notch between the lip portion and the top wall, the curved side walls of the rear section merging smoothly downward as an uninterrupted continuation of the curved side walls into a lower wall of the rear section.

2. The handgrip as in claim 1 wherein the rear section has a closed bottom end wall which merges smoothly upward into the top wall, side walls, and lower wall of the rear section.

3. The handgrip as in claim 1 wherein the front section is frustum shaped.

* * * * *